US006022162A

United States Patent [19]

Aumüller

[11] Patent Number: 6,022,162

[45] Date of Patent: Feb. 8, 2000

[54] ORAL HYGIENE APPARATUS

[76] Inventor: Hanns Aumüller, Müllner Hauptstrasse 29, A-5020 Salzburg, Austria

[21] Appl. No.: 09/092,155

[22] Filed: Jun. 5, 1998

[30] Foreign Application Priority Data

Nov. 11, 1997 [EP] European Pat. Off. ..... 97119742

[51] Int. Cl.[7] ..... A46B 11/02

[52] U.S. Cl. ..... 401/124; 401/125; 401/183; 401/269; 132/308

[58] Field of Search ..... 401/183, 123, 401/125, 269, 124; 132/308

[56] References Cited

U.S. PATENT DOCUMENTS

| | | | |
|---|---|---|---|
| 1,192,182 | 7/1916 | Gerstenzang | 401/125 |
| 1,653,987 | 12/1927 | Cliffe | 401/125 X |
| 2,401,318 | 6/1946 | Robinson et al. | 132/308 |
| 2,481,056 | 9/1949 | White | 132/308 |
| 3,653,778 | 4/1972 | Freiling | 401/183 |
| 5,348,028 | 9/1994 | Gustavel | 132/309 |
| 5,388,599 | 2/1995 | Yen | 132/311 |

FOREIGN PATENT DOCUMENTS

| | | | |
|---|---|---|---|
| 1 370 523 | 7/1964 | France . | |
| 2 089 312 | 1/1972 | France | A46B 11/00 |
| 2 630 307 | 10/1989 | France | A46B 11/02 |
| 8003546 | 12/1980 | Netherlands | A46B 15/00 |
| 194451 | 10/1922 | United Kingdom | 272/22 |
| 2215593 | 9/1989 | United Kingdom | 401/183 |
| WO 95/30352 | 11/1995 | WIPO | A46B 11/00 |

*Primary Examiner*—Steven A. Bratlie
*Attorney, Agent, or Firm*—Fitch, Even, Tabin & Flannery

[57] ABSTRACT

An oral hygiene apparatus; in particular disposable tooth brush, comprising a tank section, which has a hollow cavity provided to receive a treatment fluid, and at least one fluid outlet, preferably formed on an outlet stub, a treatment section, which includes a treatment head, in particular provided with bristles, and a cover cap which, when not in use, can be placed onto the tank section, preferably with latching, wherein, by coupling the tank section and the treatment section, a flow connection can be produced between the hollow cavity and at least one fluid outlet opening provided in the treatment head and a fluid flow can be produced by the action of pressure onto the tank section, which is of elastic design, at least regionally, from the hollow cavity via the fluid outlet in the direction of the fluid outlet opening, and wherein the cover cap, in the mounted state, closes the fluid outlet at the tank section and at least partly covers the treatment head of the treatment section.

11 Claims, 1 Drawing Sheet

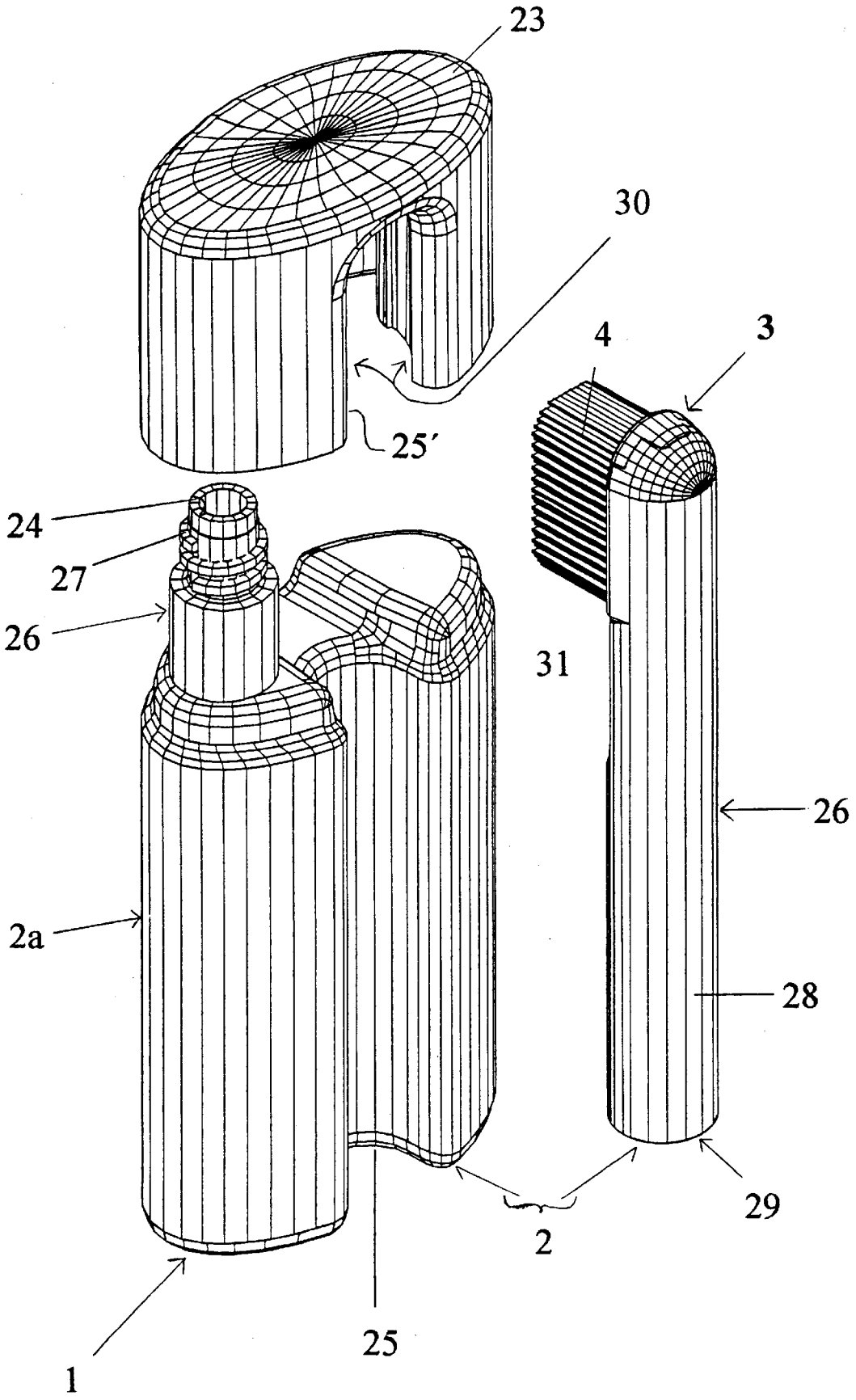
23
30
4
3
25′
24
27
26
31
26
2a
28
29
2
25
1

ORAL HYGIENE APPARATUS

BACKGROUND OF THE INVENTION

The invention relates to an oral hygiene apparatus, in particular to a disposable tooth brush.

For the use of customary tooth brushes one requires, as a rule, a dentifrice stored in a separate container.

For this reason the use of customary tooth brushes is, for example, complicated on journeys, in restaurants or in similar places, because one not only has to carry the tooth brush but rather also the dentifrice.

This complicated handling which arises with the mobile use of a tooth brush leads to one turning, for example, to mouth washes or special chewing gums, with which however no adequate oral treatment can be achieved from the point of view of hygiene.

SUMMARY OF THE INVENTION

An object of the invention is to provide an oral hygiene apparatus which is in particular suitable for mass production and which makes it possible to achieve oral treatment which is satisfactory with respect to of hygiene at any desired location and in the simplest manner.

This object is satisfied in accordance with the embodiments of the invention by the provision of a tank section, which has a cavity provided to receive a treatment fluid, and at least one fluid outlet, preferably formed on outlet stub, a treatment section, which includes a treatment head, in particular provided with bristles, and a cover cap which, when not used, can be placed onto the tank section, preferably with latching, wherein, by coupling the tank section and the treatment section, a flow connection can be produced between the cavity and at least one fluid outlet opening provided in the treatment head, and a fluid flow can be produced from the cavity via the fluid outlet in the direction of the fluid outlet opening, by the action of pressure on the tank section, which is preferably compressible, and wherein the cover cap in the pre-use construction closes the fluid outlet at the tank section and at least partly covers the treatment head of the treatment section.

The oral hygiene apparatus of the invention is an extremely practical article with which oral treatment is possible without any additional treatment means. The oral hygiene which can be achieved with it is comparable with that which can be achieved by the comparatively clearly more complicated customary tooth cleaning.

The oral hygiene apparatus in accordance with the invention can be used almost everywhere as a result of its independence from additional treatment preparations and offers the possibility of ideal oral treatment, in particular in situations where customary tooth cleaning is not possible or at least be associated with considerable complications.

The provision of a cover cap which, when the apparatus is not in use, prevents the treatment fluid from running out of the cavity and simultaneously covers at least part of the treatment head, which is provided with bristles in the preferred embodiment, enhances in advantageous manner the acceptance of such items which are dispensed as impersonal, mass produced articles, for example, at automatic vending units. The user can namely see with his own eyes that the critical hygienic consideration is that the treatment head which is placed in the mouth is reliably protected against external influences, independently of an additional outer packaging, which can be easily damaged.

The multi-part design in connection with the special cover cap furthermore makes it possible to assemble the health treatment apparatus into a compact, space-saving unit when not in use, in particular during transport and storage, without the danger of the treatment fluid escaping, and without having to provide fluid barriers, which are complicated to manufacture and which must first be cancelled by the user prior to use.

A simple design of the individual parts of the health treatment apparatus is made possible in this manner, which is advantageous, particularly having regard to mass production.

A further advantage which results from the lack of necessity to use special fluid barriers lies in the fact that after use which has not consumed all the treatment fluid, the oral hygiene apparatus can be put back together into the initial state. At a later time the remaining treatment fluid can be used for at least one further oral care treatment without the danger of escape of the fluid arising in the intervening time period.

In accordance with a preferred embodiment of the oral hygiene apparatus of the invention, the tank section has a recess, in particular a groove-like recess, into which the treatment section can be at least partly and preferably received when not used in such a way that the treatment head is arranged in the region of the fluid outlet.

This design enables the use of a comparatively simply designed cover cap, since the fluid outlet which is to be closed off by the cover cap and the treatment head which is to be at least partly covered over at the same time lie close together. Simple, low-cost manufacturing and also a further saving of space are thus made possible.

In accordance with a further embodiment of the oral hygiene apparatus of the invention, the tank section, the treatment section and the cover cap can be assembled into a compact, overall body with a minimum space requirement and having an outer surface which is substantially free of projections. In addition to a further reduction of the transport and storage costs, in particular for large numbers, it is ensured in this manner that the oral hygiene apparatus can be transported without problem in, for example, handbags, or indeed in the pockets of articles of clothing, and can thus be simply carried on every occasion.

In accordance with a further preferred embodiment the cover cap is provided with a projection, which is in particular designed in the manner of a closure plug, which closes off the fluid outlet of the tank section when the cover cap is in place. This represents a particularly simple way of "automatically" closing off the fluid outlet in a manner safe against leakage when setting the cover cap in place, and indeed both from the point of view of manufacture as well as handling.

In this respect the design of a comparatively short projection at the cover cap suffices when the fluid outlet of the tank section is formed, in accordance with a preferred embodiment, on an outlet stub, which projects from the tank section and which is in particular provided with an outer thread for coupling to the treatment section.

In accordance with a further preferred embodiment the treatment section is kept in a manner secure against loss when not used by the mounted cover cap, preferably in the region of the treatment head. In this respect the cover cap not only serves as a closure and cover but rather at the same time as a holding member for the treatment section and takes treatment in simple manner that all the individual parts of the oral hygiene apparatus of the invention are kept together.

In accordance with a further embodiment of the oral hygiene apparatus of the invention, the cover cap can be mounted in use onto a base region of the tank section which preferably lies opposite to the fluid outlet, preferably with latching. In this way the cover cap is indeed useful during the use of the oral hygiene apparatus in that it enlarges the tank section and provides in this manner a grip or handle which can be better handled by the user.

Moreover, the cover cap can in this way not be lost, which is of advantage, in particular having regard to a possibly desired multiple use.

In accordance with a further preferred embodiment, the tank section and the treatment section can be screwed together to produce the flow connection between the cavity and the fluid outlet opening. In this way a simple type of coupling of the two parts, which is problem-free from the technical manufacturing viewpoint, but nevertheless stable and also simple from the point of view of its handling, is provided.

In accordance with another further development, a fluid inlet opening of the treatment section is closed off in the assembled state by a cover plate, which is preferably formed in one piece on the tank section and/or by a liquid barrier which can be overcome by coupling the treatment section to the tank section.

The penetration of contamination into the fluid channel between the fluid inlet opening and the fluid outlet opening, which is in particular provided in the region of the bristles, is thereby prevented in a manner which is clearly visible to the user, at least in the case of a cover plate, which is in particular of advantage if an additional packaging is damaged.

Through the possible design of the elastic region of the handle of light permeable material in accordance with a further preferred design of the oral hygiene apparatus of the invention, an advantageous effect is achieved from esthetic points of view. This effect has an advantageous psychological effect on the user, because he sees the treatment fluid to be used in the oral care treatment prior to its use. The use of a colored treatment fluid can increase these effects.

The oral hygiene apparatus of the invention is of advantage above all for airlines and railway companies, restaurants etc. who wish to offer their customers or guests a simple and cost favorable oral hygiene, because the simple design of the oral hygiene apparatus of the invention enables its mass production at low unit cost.

As a result of manufacture of its individual parts from recyclable materials, a further preferred embodiment of the oral hygiene apparatus of the invention has a good compatibility with the environment.

Further designs of the invention are set forth in the subordinate claims.

THE FIGURE

The invention will be described in the following by way of example and with reference to the drawing, the single FIGURE which shows a perspective illustration of an embodiment of an oral hygiene apparatus in accordance with the invention.

DESCRIPTION OF PREFERRED EMBODIMENTS

The FIGURE shows an embodiment of an oral hygiene apparatus 1 in accordance with the invention, in which the two separate parts 2*a* and 2*b* and also a cover cap 23 are provided. The part 2*a*, the tank section, forms the largest part of a handle 2, and includes a cavity filled with a treatment fluid. The cavity has essentially the shape of a cylinder with approximately elliptical cross-section, but with a groove-like, longitudinal recess 25, being provided.

The tank section 2*a* also has an outlet stub 26 projecting at its one end face and extending substantially parallel to the groove-like recess 25, with the outlet stub being provided with an outer thread 27 in the region of a fluid outlet 24.

The other part of the handle 2, the treatment section 2*b*, includes a substantially hollow cylindrical shaft 28, which forms the smaller part of the handle member 2. A treatment head 3 is formed at one end of the shaft 28 and is provided at one side with bristles 4 manufactured preferably of polyethylene.

The end of the treatment section 2*b* remote from the bristles 4 is provided in the region of a fluid inlet opening 29 of the shaft 28 with an inner thread, which mates with the outer thread 27 of the tank section 2*a*. In this way the treatment section 2*b* can be screwed by a user onto the tank section 2*a* in order to produce a flow connection of the treatment fluid from the hollow cavity of the tank section 2*a* to one or more fluid outlet openings, which open into the region of the bristles 4, but cannot be seen in the drawing.

The entire treatment section 2*b* is preferably made in one piece, preferably including the bristles 4.

The wall of the tank section 2*a* is preferably made elastic, at least regionally, so that the user of the treatment fluid can press the treatment fluid through the fluid passage, which is formed in the screwed together state (use configuration) by the outlet stub 26 and the hollow shaft 28 of the treatment section 2*b*, to the treatment head 3 and thus out of the fluid outlet opening or openings.

The tank section 2*a* and the treatment section 2*b* can be put together into a compact unit in the non-screwed together state, i.e. particularly in the period between manufacture and use of the oral hygiene apparatus of the invention (pre-use configuration), because the shape and the length of the shaft 28 of the treatment section 2*b* are selected so that the treatment section 2*b* at least substantially fills out the groove-like recess 25 of the tank section 2*a* in the assembled state and the rear side of the shaft 28 remote from the bristles 4 terminates approximately flush with the outer surface regions adjoining the groove-like recess 25 on both sides. The bristles 4 are thereby located adjacent to the outlet stub 26.

Furthermore, a cover cap 23 is provided, which has substantially the same cross-section as the tank section 2*a*, with the treatment section 2*b* arranged in the recess 25. The cover cap 23 can be placed, preferably in latching manner, onto the side or end of the assembled parts 2*a*, 2*b*, having the outlet stub 26 and the bristles 4. The wall of the cover cap 23 is interrupted by a cut-out region 25' with an approximately U-shaped outline, which, with the cover cap 23 set in place, adjoins the groove-like recess 25 and serves to receive the region of the shaft 28, which does not lie in the recess 25.

A projection, which is in particular formed in closure plug-like manner and preferably in one piece with the end face of the cover cap 23, is preferably provided in the interior of the cover cap 23 (cannot be seen in the FIGURE) and closes off the fluid outlet 24 in fluid tight manner when the cover cap 23 is in place. The escape of the treatment fluid in the unused state is reliably prevented in this manner with any orientation of the oral hygiene apparatus 1.

In the fully assembled state of the embodiment of an oral hygiene apparatus 1 in accordance with the invention, as shown in the FIGURE, the bristles 4 and also the outlet stub 26 are fully protected in the interior of the cover cap 23 and thus protected against external influences in a way and means which is unobjectionable with respect ot hygiene. Moreover, as a result of the described shaping of the individual parts of the oral hygiene apparatus 1, an overall body results which is convenient to handle and has a minimal space requirement, with the outer surface of the overall body being free of disturbing projections and being capable of being transported and stored without problem.

The fluid inlet opening 29 of the shaft 28 can be closed in the assembled state, and thus likewise protected from external influences, by a cover plate (not shown), which is formed in the base region of the tank section 2*a* opposite to the outlet stub 26, and which extends approximately parallel to the base of the tank section 2*a* and is preferably formed in one piece with the latter, .

The cover cap 23, in particular the margin of the U-shaped cutout region 25' and also the treatment head 3, in particular the edge region of its side confronting the bristles 4 are provided with longitudinal recesses 30 and longitudinal ribs 31, respectively, which fit together to ensure that the treatment section 2*b* cannot be lost in the assembled state.

In accordance with the embodiment shown in the FIGURE, longitudinal ribs 31 serve as the holding means for the treatment section 2*b*, while the cover cap 23 is formed with groove-like longitudinal recesses 30, in which the longitudinal ribs 31 are slidingly guided when setting the cover cap 23 in place.

In the event that the cover cap 23 is first set in place, the treatment section 2*b* with the longitudinal ribs can subsequently be latchingly engaged into the longitudinal ribs 30 and the shaft 28 enters into the groove-like recess 25.

The edge region of the U-shaped cutout region 25' can also simply serve as the holding means 30 for the cover cap 23, with the longitudinal ribs 31 of the treatment section 2*b* retainingly engaging behind the edge region of the U-shaped cutout in the assembled state.

Alternatively, or additionally, the retaining means 30, 31 can also be omitted, and the shaft can be made with appropriate dimensioning so that it can be clampingly inserted into the groove-like recess 25 and is thus likewise secure against loss.

At least the elastic region of the tank section 2*a* is preferably manufactured of a soft plastic, such as soft polyvinyl. Furthermore, all the individual parts of the oral hygiene apparatus 1 of the invention, including the treatment section 2*b*, provided in one piece with the bristles 4, are preferably capable of being manufactured by the injection molding process.

Recyclable materials are preferably used, at least in large part, so that the oral hygiene apparatus 1 of the invention is readily environmentally acceptable.

The storage and/or presentation of the oral hygiene apparatus 1 preferably takes place in a transparent plastic package. A light permeable design of the tank section 2*a*, at least regionally, in conjunction with the use of a colored treatment fluid can ensure the already mentioned positive effects.

The packaging of the oral hygiene apparatus is preferably closed in air tight manner in order to ensure its storage is problem-free with respect to hygiene.

For the use of the oral hygiene apparatus 1, following its removal from its packaging, the cover cap 23 must first be removed and then the treatment section 2*b* has to be screwed onto the tank section 2*a*. Through the action of pressure onto the elastic region of the tank section 2 the treatment fluid contained in the cavity passes to the treatment head 3 and is thus available for mouth treatment, in particular to assist tooth cleaning, by a mechanical route by means of the bristles 4.

The base region of the tank section 2*a* lying opposite to the outlet stub 26 can be formed in such a way that the cover cap 23 can be latchingly placed onto this region. In this way the tank section 2*a* and thus the grip 2 is enlarged, on the one hand, and an unintentional loss of the cover cap 23 is prevented, on the other hand.

The oral hygiene apparatus 1 permits a simple but effective intermediate cleaning, for which neither additional treatment means nor water are required, and which has the consequence of both a significant improvement of oral hygiene as well as a pleasant, feeling of freshness for the user. The treatment fluid can simply be spat out after the oral hygiene treatment has been completed.

The quantity of treatment fluid should preferably be dimensioned in such a way that it is sufficient for a single oral hygiene treatment. After use the oral hygiene apparatus 1 can be thrown into collecting containers, which have been made available for this, and later sent for recycling.

As a result of the possibility of reassembling the oral hygiene apparatus without problem, multiple use can also take place with a correspondingly frugal use of the treatment fluid, without the danger of the remaining treatment fluid leaking out in the meantime.

What is claimed is:

1. A disposable oral hygiene apparatus having a pre-use configuration and a use configuration, said apparatus comprising:

a tank section defining a cavity therein for receiving and storing a treatment fluid, said tank section having at least one fluid outlet;

a treatment section including a treatment head having bristles thereon, a fluid outlet proximate said treatment head, and a fluid inlet remote from said treatment head on said treatment section; and a cover cap for covering said tank section and said fluid outlet of said tank section and at least partly covering said treatment head of said treatment section when said apparatus is in said pre-use configuration;

wherein said fluid inlet of said treatment section can be coupled with said fluid outlet of said tank section to place said apparatus in its use configuration and to produce a flow connection between said cavity of said tank section and said fluid outlet of said treatment section, such that said treatment fluid can be dispensed through said fluid outlet of said tank section and into said treatment section by providing compression to said tank section.

2. An apparatus in accordance with claim 1 wherein said tank section includes a recess into which said treatment section is partly received when said apparatus is in said pre-use configuration.

3. An apparatus in accordance with claim 2 wherein said cover cap includes a generally U-shaped cut away for adjoining said recess and for receiving a portion of said treatment section not received by said recess.

4. An apparatus in accordance with claim 1 wherein said cover cap includes a closure plug for closing said fluid outlet of said tank section when said apparatus is in said pre-use configuration.

5. An apparatus in accordance with claim 1 wherein said cover cap secures said treatment section when said apparatus is in said pre-use configuration.

6. An apparatus in accordance with claim 1 wherein said tank section includes a base portion generally opposite said fluid outlet of said tank section a nd said cover cap is securable to said base portion when said apparatus is in said use configuration.

7. An apparatus in accordance with claim 1 wherein said fluid inlet of said treatment section can be coupled with said fluid outlet of said tank section by screwing said fluid inlet and said fluid outlet together.

8. An apparatus in accordance with claim 1 wherein said fluid inlet of said treatment section includes a cover plate for preventing foreign matter entering therein when said apparatus is in said pre-use configuration, wherein said cover plate is disabled when said fluid inlet of said treatment section is coupled with said fluid outlet of said tank section so as to permit flow of treatment fluid therethrough when said apparatus is in said use configuration.

9. An apparatus in accordance with claim 1 wherein said bristles are manufactured of polyethylene.

10. An apparatus in accordance with claim 1 wherein said tank section includes a region that is compressible such that flow of treatment fluid may be implemented by compression thereof and light-permeable such that said treatment fluid may be visible therethrough.

11. A disposable oral hygiene apparatus having a pre-use configuration and a use configuration, said apparatus comprising:

a tank section defining a cavity therein for receiving and storing a treatment fluid, said tank section having at least one fluid outlet and including a recess;

a treatment section including a treatment head having bristles thereon, a fluid outlet and a fluid inlet, said treatment section being partly received in said recess of said tank section when said apparatus is in said pre-use configuration; and a cover cap for covering said tank section and said fluid outlet of said tank section and at least partly covering said treatment head of said treatment section when said apparatus is in said pre-use configuration, said cover cap including a generally U-shaped cut away for adjoining said recess and for receiving a portion of said treatment section not received by said recess;

wherein said fluid inlet of said treatment section can be coupled with said fluid outlet of said tank section to place said apparatus in its use configuration and to produce a flow connection between said cavity of said tank section and said fluid outlet of said treatment section, such that said treatment fluid can be dispensed through said fluid outlet of said tank section and into said treatment section by providing compression to said tank section.

* * * * *